US008491056B2

(12) United States Patent
Berryhill

(10) Patent No.: US 8,491,056 B2
(45) Date of Patent: Jul. 23, 2013

(54) CUSHION

(75) Inventor: Rusty Berryhill, New Albany, MS (US)

(73) Assignee: Kevin Charles Furniture, LLC, Tamarac, FL (US)

( * ) Notice: Subject to any disclaimer, the term of this patent is extended or adjusted under 35 U.S.C. 154(b) by 244 days.

(21) Appl. No.: 13/078,669

(22) Filed: Apr. 1, 2011

(65) Prior Publication Data

US 2012/0248845 A1 Oct. 4, 2012

(51) Int. Cl.
*A47C 17/00* (2006.01)
*A47C 7/02* (2006.01)

(52) U.S. Cl.
USPC ..... 297/452.27; 297/452.58; 5/727; 5/740

(58) Field of Classification Search
USPC ..... 297/452.27, 452.58; 5/727–730, 5/740, 655.9
See application file for complete search history.

(56) References Cited

U.S. PATENT DOCUMENTS

| | | | | |
|---|---|---|---|---|
| 2,192,601 | A * | 3/1940 | Mattison | 5/729 |
| 3,210,781 | A | 10/1965 | Pollock | |
| 3,222,698 | A | 12/1965 | Levenson | |
| 3,751,111 | A | 8/1973 | Taylor et al. | |
| 4,213,214 | A | 7/1980 | Gilhooly | |
| 4,889,387 | A * | 12/1989 | Gregory | 297/452.27 |
| 5,442,823 | A | 8/1995 | Siekman et al. | |
| 5,604,021 | A | 2/1997 | Wagner | |
| 5,791,736 | A | 8/1998 | Herbert | |
| 7,238,630 | B2 | 7/2007 | Steagall et al. | |
| 8,141,957 | B2 * | 3/2012 | McClung et al. | 297/452.27 |
| 8,308,235 | B2 * | 11/2012 | Ellison et al. | 297/216.1 |
| 2003/0009830 | A1 * | 1/2003 | Giori et al. | 5/709 |
| 2007/0209120 | A1 * | 9/2007 | Clark | 5/729 |
| 2010/0107392 | A1 * | 5/2010 | Ali et al. | 29/91.1 |
| 2011/0197363 | A1 * | 8/2011 | Kokenes et al. | 5/652 |

FOREIGN PATENT DOCUMENTS

| | | | |
|---|---|---|---|
| DE | 102004039630 | A1 | 2/2006 |
| JP | 5235265 | A | 3/1977 |
| JP | 11216042 | A | 8/1999 |
| JP | 200565829 | A | 3/2005 |

* cited by examiner

*Primary Examiner* — Sarah B McPartlin
(74) *Attorney, Agent, or Firm* — Christopher & Weisberg, P.A.

(57) ABSTRACT

A six-sided box-type cushion is described that has characteristics that not only offer targeted support for the user, but also allow the cushion to be reversible in that the user's perceived firmness is the same no matter which seating surface is facing up. In particular, the cushion has a first, second, third, and fourth faces, and a first and second seating surface. The cushion comprises a plurality of substantially coplanar firmness zones, each zone having a uniform firmness throughout, and the positioning of the firmness zones relative to each other creates a firmness gradient from the first face end to the second face end of the cushion. The first firmness zone at the first face end of the cushion is the most firm, the third firmness zone at the second face end of the cushion is the least firm, and the second one or more firmness zones are of intermediate firmness. The cushion is at least partially enveloped by a cushion cover layer, and may additionally include a seating surface cover layer on each of the first and second seating surfaces.

16 Claims, 2 Drawing Sheets

CUSHION

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to a cushion, and in particular to a six-sided box-type seating cushion as used on couches, chairs, and other home or office furniture.

BACKGROUND OF THE INVENTION

It is well known in the art that cushions or other soft seating pads are not only functional in providing increased user comfort, but are also an important decorative feature in a living space. When selecting cushions for use in the home or office, it is important that the cushions embody a balance between utility and aesthetics.

As is especially true for couches, furniture cushions frequently become soiled or worn, creating an unacceptable appearance. Upholstery cleaning products rarely completely remove the stain, and they do nothing for the appearance of worn fabric. A common solution to stains and faded fabric is simply flipping over the cushion; however, oftentimes this will change the feel of the seating because the cushion does not contain the same fill elements on both sides or the fill is not evenly distributed throughout the cushion.

Furthermore, it is uncommon that a single cushion will contain a variety of firmness levels to enhance seating comfort. For instance, a cushion will either be too soft or too hard, or will not offer the correct amount of support for different areas of the body such as the knees or buttocks. Prolonged use of a cushion that offers poor support can result in back and joint pain, neck pain, and increased fatigue. Many cushions that do offer the proper support are unattractive or do not match upholstery fabric or a decorating scheme.

It is therefore desirable to combine utility and aesthetics in a single product by providing a cushion that is both reversible by having uniform comfort characteristics on both the top and bottom surfaces so that there is no perceivable change in comfort when the cushion is flipped over to hide stains or wear and offers a variety of firmness zones while being attractive enough to use on an important piece of furniture.

SUMMARY OF THE INVENTION

The present invention overcomes many of the shortcomings of the prior art by providing a cushion that offers a variety of firmness zones to enhance seating comfort and is reversible in that the user's perceived firmness is the same no matter which seating surface is facing up. The cushion may also be upholstered to match and be used on a couch or other item of furniture.

The cushion includes first, second, third and fourth faces, and first and second seating surfaces to define a typical six-sided box-type cushion as is commonly used on couches, chairs, and other home or office furniture. The area of each of the seating surfaces is greater than the area of any of the first, second, third, and fourth faces. The seating surfaces are also mirror images of each other, just as the third and fourth faces are mirror images of each other.

The cushion may also comprise a plurality of adjacent, substantially coplanar firmness zones, each zone having a uniform firmness throughout. The positioning of these zones in relation to each other creates a firmness gradient from the first face end to the second face end of the cushion. The first firmness zone nearest the first face end of the cushion may be firmer than the second firmness zone, which may be firmer than the third firmness zone, and so on, moving toward the second face end of the cushion. The firmness zones may be composed of foam such as latex, polyurethane, or memory foam; cotton; hair; fiber; or any other type of filling material that is used in the industry for furniture cushions. Each firmness zone is made from a single type of filling material that has uniform characteristics (such as density and compression strength) throughout the zone. This list of materials is meant to be illustrative only, and in no way is meant to restrict the invention to particular types of filling materials.

The cushion may be at least partially enveloped by at least one cushion cover layer. The cushion cover layer may be of a uniform thickness and firmness, and may be made of leather or a fabric material such as a fiber weave. Any type of material, whether synthetic or natural, may be used to envelope the cushion, and the decision to use a particular material may be based on economic or manufacturing considerations. For example, the fabric of the cushion cover layer may at least partially consist of cotton.

The cushion may additionally comprise two additional cover layers: the first and second seating surfaces may be paneled with a first and second seating surface cover layer, respectively. The first and second seating surface cover layers may be of a uniform thickness and firmness, and may be made of any material suitable for use in furniture cushions, including leather, plastic, or fabric material such as a fiber weave or cotton.

The filling material, paneled with the first and second seating surface cover layers, may then be partially enveloped by a cushion cover layer on all faces and surfaces except the second face, creating a cushion that has three cover layers: a cushion cover layer plus two seating surface cover layers.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
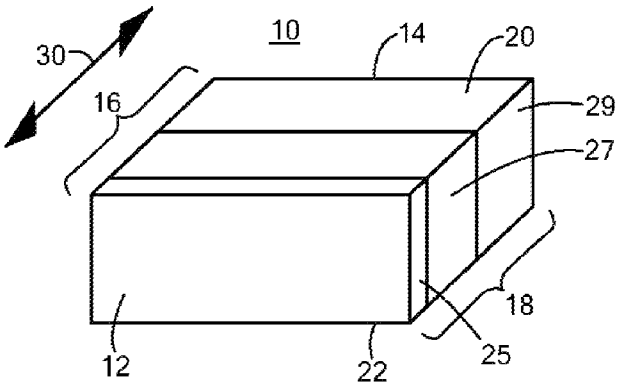
FIG. 1 is a perspective view of the cushion having three firmness zones, showing a reference line for measuring the length of the cushion.

FIG. 1 shows a cushion (10) having a first face (12), a second face (14), a third face (16), a fourth face (18), a first seating surface (20) and a second seating surface (22). The third (16) and fourth (18) faces are mirror images of each other, and the first (20) and second (22) seating surfaces are mirror images of each other. As a result of this symmetry, when the first face (12) is facing forward, the cushion (10) will be exactly the same whether the first (20) or second (22) seating surface is facing up. Additionally, the area of each of the seating surfaces is greater than the area of any of the first, second, third, and fourth faces. The cushion (10) shown in FIG. 1 includes three substantially coplanar firmness zones: a first firmness zone (25), a second firmness zone (27), and a third firmness zone (29). The second (16) and third (18) faces include all three firmness zones (25, 27, 29), wherein each of the first (12) and second (14) faces include only a single firmness zone (25 or 29, respectively).

As shown in FIG. 1, the first firmness zone (25) nearest the first face (12) is firmer than the second firmness zone (27), which is in turn firmer than the third firmness zone (29) nearest the second face (14). The first firmness zone (25) is meant to provide stronger support for the user's legs, beneath the knees. The third firmness zone (29) nearest the second face (14) is where the least amount of the user's body weight is usually centered and this zone is the least firm. Each firmness zone comprises a single type of filling material that has uniform characteristics (such as density and compression strength) throughout the zone.

Each of the adjacent substantially coplanar firmness zones may represent different percentages of the total length of the cushion, measured along the reference line (30) running axially between the first face (12) and the second face (14) of the cushion. For example, the first firmness zone may comprise from about 10% to 15% of the length of the cushion, the third firmness zone may comprise from about 10% to 30% of the length of the cushion, and the second firmness zone may comprise from about 60% to 75% of the length of the cushion. Because of these value ranges, the firmness zones shown in FIG. 1, or indeed in any of the figures, may or may not be drawn to scale.

The firmness zones, which make up the filling of the cushion (10), may be composed of foam such as latex, polyurethane, or memory foam; cotton; hair; fiber; or any other type of filling material that is used in the industry for furniture cushions. This list of materials is meant to be illustrative only, and in no way is meant to restrict the invention to particular types of filling materials. Filling materials are available in a wide variety of densities (measured herein as $kg/m^3$, which may be converted to the non-metric equivalent of $lb/ft^3$) and compression strengths (measured herein as kilogram-force $(kgf)/cm^3$, which may be converted to the non-metric equivalent of $lb/in^2$). "Density" is a measurement of mass per unit volume, and does not necessarily directly correlate to the user's perceived firmness. "Compression strength" is a measurement of the filling material's ability to withstand axially directed pushing forces, and typically is directly related to perceived firmness. "Perceived firmness" or "firmness" refer to the "feel" of the cushion, e.g., whether a user would think the cushion is hard or soft.

As an example of the variation between firmness zones, the filling material of the first firmness zone (25) of the cushion (10) of FIG. 1 may have a density of between 25 and 28 $kg/m^3$ [27.2 $kg/m^3$] and a compression strength of between 2.5 and 3.0 $kgf/cm^3$, the filling material of the second firmness zone (27) may have a density of between 28 and 30 $kg/m^3$ and a compression strength between 2.2 and 2.5 $kgf/cm^3$, and the filling material of the third firmness zone (29) may have a density between 20 to 25 $kg/m^3$ and a compression strength between 2.0 and 2.2 $kgf/cm^3$. These values would correspond to first firmness zone (25) having a perceived firmness that is about 25% greater than the second firmness zone (27), and a second firmness zone having a perceived firmness that is about 20% greater than the third firmness zone.

Figure 2:
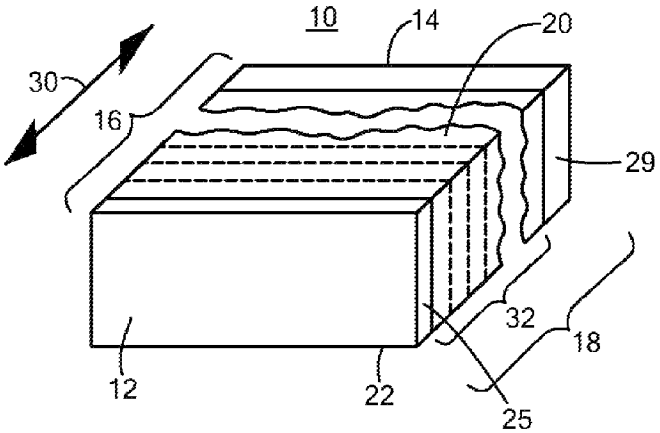
FIG. 2 is a perspective view of the cushion having more than three firmness zones, showing a reference line for measuring the length of the cushion.

FIG. 2 shows a cushion (10) similar to that of FIG. 1, but having more than three substantially coplanar firmness zones. When the cushion includes more than three firmness zones, the cushion has a first firmness zone (25), a last firmness zone (29), and a plurality of middle firmness zones (32). The plurality of middle firmness zones are together given a single reference number (32), but each zone will have unique density and compression strength characteristics.

Each of the adjacent substantially coplanar firmness zones may represent different percentages of the total length of the cushion, measured along the reference line (30) running axially between the first face (12) and the second face (14) of the cushion. For example, the first firmness zone (25) may comprise from about 10% to 15% of the length of the cushion, the last firmness zone (29) may comprise from about 10% to 30% of the length of the cushion, and the plurality of middle firmness zones (32) may comprise from about 60% to 75% of the length of the cushion. Because of these value ranges, the firmness zones shown in FIG. 1, or indeed in any of the figures, may or may not be drawn to scale. The second (16) and third (18) faces include all firmness zones (25, 32, 29), wherein each of the first (12) and second (14) faces include only a single firmness zone (25 or 29, respectively).

Figure 3:
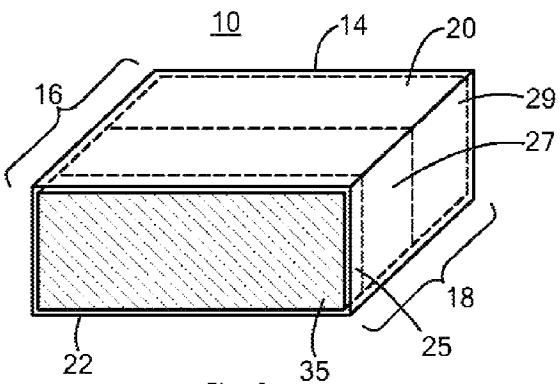
FIG. 3 is a cross-section view of the first firmness zone of the cushion, showing the location of the cushion cover layer relative to the filling material.

FIG. 3 shows a cross-section view of a cushion (10) like that of either FIG. 1 or FIG. 2, which is at least partially enveloped by a cushion cover layer (35). The cushion cover layer is an integral part of the cushion, and is not removable from the cushion. The cushion cover layer (35) may be of a uniform thickness and firmness, and may be made of leather or a fabric material such as a fiber weave. Any type of material, whether synthetic or natural, may be used to envelope the cushion, and the decision to use a particular material may be based on economic or manufacturing considerations. For example, the fabric of the cushion cover layer may at least partially consist of cotton. FIG. 3 is a cross-sectional view, the cut being made in the first firmness zone (25), or axially from the first seating surface (20) to the second seating surface (22). This cut through the first firmness zone (25) is depicted as patterned lines. The firmness zones (25, 27, 29) located under the cushion cover layer (35) are depicted in dashed lines.

Figure 4:
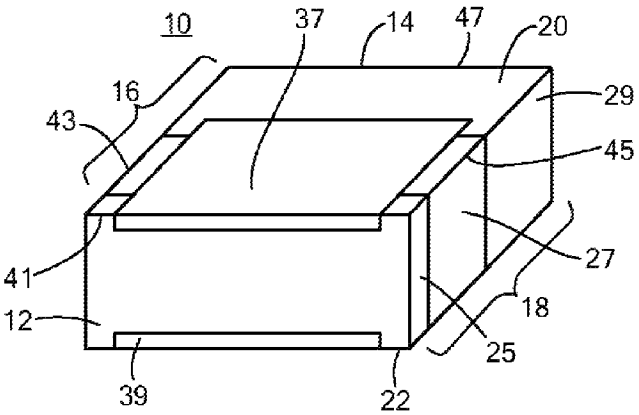
FIG. 4 is a top view of the cushion, showing the first seating surface cover layer and the first seating surface cover layer.

Referring to FIG. 4, the first (20) and second (22) seating surfaces of the cushion (10) may be paneled with a first seating surface cover layer (37) and a second seating surface cover layer (39), respectively. For example, the first seating surface (20) may comprise, nearest the filling material, a first seating surface cover layer (37), and then a cushion cover layer (35) as the outermost layer. Because the first (20) and second (22) seating surfaces are mirror images of each other, the second seating surface (22) would have a similar construction with the filling material filling being paneled with a second seating surface cover layer (39) and then a cushion cover layer (35) as the outermost layer.

The first (37) and second (39) seating surface cover layers may be of a uniform thickness and firmness, and may be made of leather or a fabric material such as a fiber weave or cotton. The seating surface cover layers may be made of a material that is thicker, stiffer, or firmer than that of the cushion cover layer, thereby adding additional support. Likewise, the seating surface cover layers may be made of a material that is firmer but weighs less than that of the cushion cover layer; for instance, the seating surface cover layer could be made of a fiberglass mat with a weight of 51 g/m$^2$, whereas the cushion cover could be made of cotton canvas with a weight of 272 g/m$^2$. Any type of material, whether synthetic or natural, may be used as a seating surface layer to panel the filling material, and the decision to use a particular material may be based on economic or manufacturing considerations.

Figure 5:
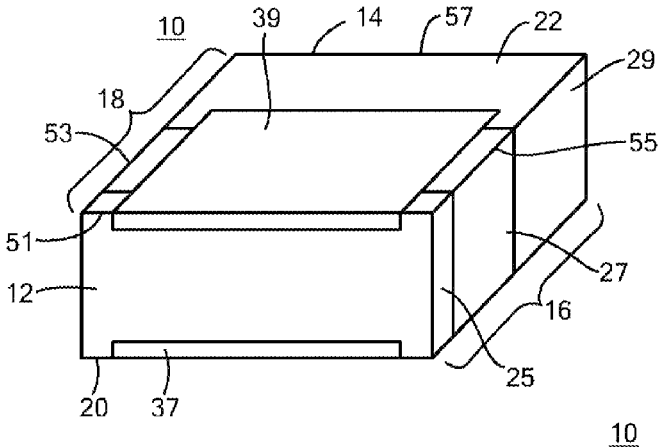
FIG. 5 is a bottom view of the cushion, showing the second seating surface cover layer and the second seating surface cover layer.

As shown in FIGS. 4 and 5, the first (37) and second (39) seating surface cover layers may each have an area that is less than the area of each of the first (20) and second (22) seating surfaces, but the first (37) and second (39) seating surface cover layers substantially cover the first (20) and second (22) seating surfaces, respectively. FIG. 4 shows the first seating surface cover layer (37) situated on top of the cushion (10) so that it meets the upper edge (41) of the first face (12), but is offset from the upper edges of the second (14), third (16), and fourth (18) faces, numbered (43), (45), and (47), respectively. Because the first (20) and second (22) seating surfaces are mirror images of each other, the second seating surface (22) is similarly covered by the second seating surface cover layer (39), which meets the upper edge (51) of the first face (12), but is offset from the upper edges of the second (14), third (16), and fourth (18) faces, numbered (53), (55), and (57), respectively. Reference numbers 51, 53, 55, and 57 refer to the upper edges of the second (14), third (16), and fourth (18) faces when the second seating surface (22) is facing upward, as shown in FIG. 5. The offset measurements (distance between either the first (20) or second (22) seating surfaces from the upper edges of the second, third, and fourth faces (14, 16, 18)) can be as little as 1% or as much as 35% of the total width of the first (37) or second (39) seating surface, measured in a straightline distance between the third face (16) and fourth face (18). The offset measurement from the second face (14) may be less than, equal to, or greater than the offset measurement from the third (16) and fourth (18) faces. The offset measurements from the third (16) and fourth (18) faces, however, will always be equal.

Figure 6:
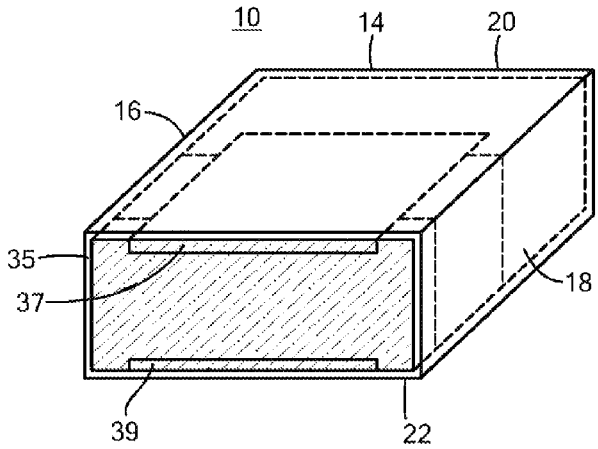
FIG. 6 is a cross-section view of the first firmness zone of the cushion, showing the location of the seating surface cover layers relative to the cushion cover layer and filling material.

FIG. 6 shows a cross-section view of the cushion (10) having a first (20) and second (22) seating surface paneled with a first (37) and second (39) seating surface cover layers, respectively, and enveloped in a cushion cover layer (35). It can be seen in FIG. 6 that the first (37) and second (39) seating surface cover layers are offset from the third (16) and fourth (18) faces; the seating surface cover layers are also offset from the second (14) face, but this is not visible in FIG. 6. The cross-sectional cut is made in the first firmness zone (25), or axially from the first seating surface (20) to the second seating surface (22), and is depicted in patterned lines. The firmness zones (25, 27, 29) located under the cushion cover layer (35) are depicted in dashed lines.

Figure 7:
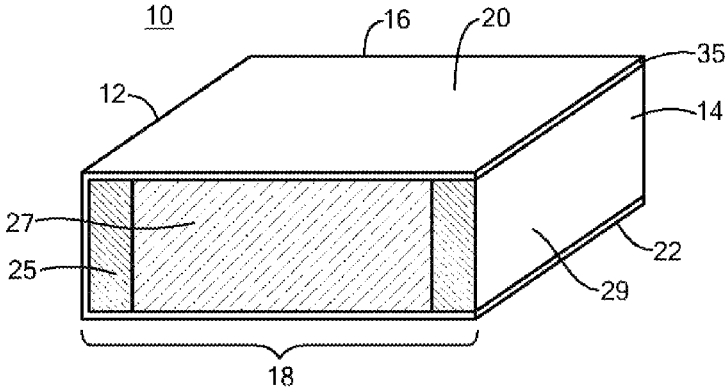
FIG. 7 is a cross-sectional view of the cushion, showing three firmness zones and a cushion cover layer that does not cover the second face.

Now referring to FIG. 7, the cushion (10) may be enveloped by the cushion cover layer (35) on all faces and surfaces except the second face (14). The cross-sectional cut is made through all firmness zones, or axially from the first face (12) to the second face (14), and is depicted in patterned lines. The configuration shown in FIG. 7 may or may not include first (37) and second (39) seating surface cover layers.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A cushion, comprising:

first, second, third, and fourth faces, the third and fourth faces are mirror images of each other;

first and second seating surfaces, the first and second seating surfaces are mirror images of each other;

first and second seating surface cover layers, the first seating surface cover layer located on the first seating surface, and the second seating surface cover layer located on the second seating surface, the first and second seating surface cover layers being the same size and having an area that is less than the area of either the first or second seating surface;

a plurality of adjacent, substantially coplanar firmness zones, each zone having a uniform firmness throughout, the positioning of the firmness zones relative to each other creating a firmness gradient spanning from the first face to the second face of the cushion, wherein the first firmness zone is firmer than a plurality of middle firmness zones, and the plurality of middle firmness zones is firmer than the third firmness zone;

an integral cushion cover layer that at least partially envelopes the cushion.

2. The cushion of claim 1, wherein the plurality of adjacent coplanar firmness zones consists of only three firmness zones:

a first firmness zone;

a second firmness zone; and a third firmness zone.

3. The cushion of claim 2, wherein the first firmness zone comprises from about 10% to 15% of the length of the cushion.

4. The cushion of claim 2, wherein the second firmness zone comprises from about 60% to 75% of the length of the cushion.

5. The cushion of claim 2, wherein the third firmness zone comprises from about 10% to 30% of the length of the cushion.

6. The cushion of claim 1, wherein the cushion cover layer covers all faces and surfaces except the second face.

7. The cushion of claim 6, wherein the cushion cover layer has a uniform thickness.

8. The cushion of claim 1, wherein the first seating surface cover layer is coterminous with the edge between the first seating surface and the first face but is offset from the edges between the first seating surface and the second, third, and fourth faces, and the second seating surface cover layer is coterminous with the edge between the second seating surface and the first face but is offset from the edges between the second seating surface and the second, third, and fourth faces.

9. The cushion of claim 1, wherein the first and second seating surface cover layers are made of fabric.

10. The cushion of claim 9, wherein the fabric comprises cotton.

11. The cushion of claim 9, wherein the fabric has a weight of about 51 g/m$^2$.

12. The cushion of claim 2, wherein the first firmness zone has a compression strength that is about 25% greater than the second firmness zone, and the second firmness zone has a compression strength that is at least 20% greater than the third firmness zone.

13. The cushion of claim 12, wherein the first firmness zone has a density of about 27.2 kg/m$^3$ and a compression strength of about 2.9 kgf/cm$^3$, the second firmness zone has a density of about 28.8 kg/m$^3$ and a compression strength of about 2.3 kgf/cm$^3$, and the third firmness zone has a density of from 20.8 to 24.0 kg/m$^3$ and a compression strength of about 2.1 kgf/cm$^3$.

14. A furniture seating cushion, comprising:

first, second, third, and fourth faces, the third and fourth faces are mirror images of each other;

first and second seating surfaces, the first and second seating surfaces are mirror images of each other;

first and second seating surface cover layers, the first and second seating surface cover layers each having the same area, the area of each seating surface cover layer being less than the area of either the first or second seating surface, the first seating surface cover layer located on the first seating surface and the second seating surface cover layer located on the second seating surface;

three adjacent, substantially coplanar firmness zones made of filling material, each zone having a uniform firmness throughout, the positioning of the firmness zones relative to each other creating a firmness gradient from the first face to the second face of the cushion, wherein the first firmness zone is firmer than he second firmness zone, and the second firmness zone is firmer than the third firmness zone;

an integral cushion cover layer that envelopes all faces and surfaces of the cushion except the second face.

15. The cushion of claim 14, wherein the first firmness zone comprises from about 10% to 15% of the length of the cushion, the second firmness zone comprises from about 60% to 75% of the length of the cushion, and the third firmness zone comprises from about 10% to 30% of the length of the cushion.

16. The cushion of claim 14, wherein the first seating surface cover layer is coterminous with the edge between the first seating surface cover layer and the first face of the cushion but is offset from the second, third, and fourth faces, and the second seating surface cover layer is coterminous with the edge between the second seating surface cover layer of the first face but is offset from the edges between the second seating surface cover layer and the second, third, and fourth faces.

* * * * *